US005415011A

United States Patent [19]

Gilmore et al.

[11] Patent Number: 5,415,011

[45] Date of Patent: May 16, 1995

[54] EXHAUST AND FRESH AIR VENTILATION SYSTEM FOR A ROOM AIR CONDITIONER

[75] Inventors: Douglas A. Gilmore, Antioch; Pamela K. Dorris; Roy E. Dorris, both of Nashville, all of Tenn.

[73] Assignee: Whirlpool Corporation, Benton Harbor, Mich.

[21] Appl. No.: 143,947

[22] Filed: Oct. 27, 1993

[51] Int. Cl.[6] ..... F25D 23/12

[52] U.S. Cl. ..... 62/262; 62/325; 62/426

[58] Field of Search ..... 62/262, 325, 426, 427, 62/428, 407

[56] References Cited

U.S. PATENT DOCUMENTS 3,823,574 7/1974 Bolton ..... 62/262
3,841,110 10/1974 Schuster et al. ..... 62/262
5,065,597 11/1991 Farfaglia et al. ..... 62/262
5,295,531 9/1994 Tsunekawa et al. ..... 62/262

*Primary Examiner*—John M. Sollecito
*Attorney, Agent, or Firm*—Thomas J. Roth

[57] ABSTRACT

A room air conditioner is provided with a ventilation system for exhausting room air to the outdoors through the air conditioner or alternatively for admitting fresh air from outdoors in through the air conditioner. The actuator is a rotary knob which has a pair of cables attached to it such that rotary motion of the knob in the first direction will cause one of the cables to pull on one of the doors to open it, while rotary motion of the knob in the other direction will cause the other of the cables to pull on the other door to open it. The doors are spring biased to return to the closed position and the knob has a detent device to hold it in a selected open or closed position.

15 Claims, 3 Drawing Sheets

FIG. 4
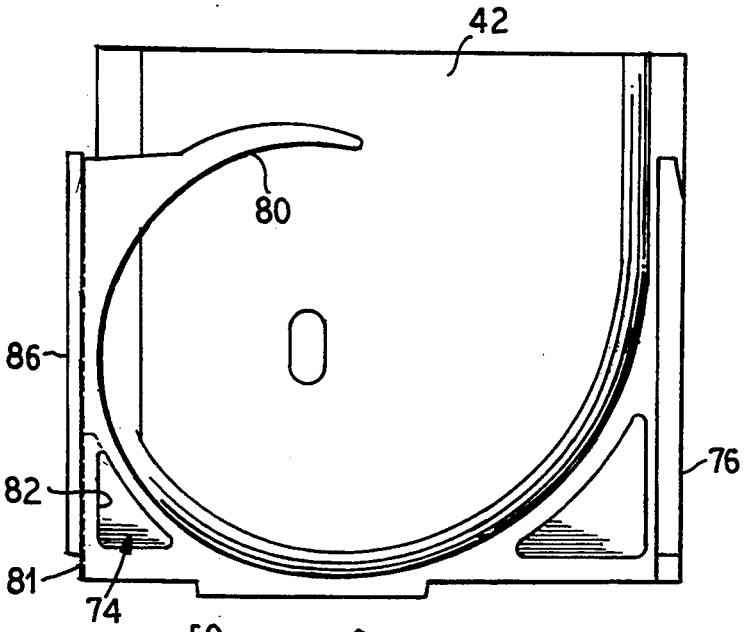
FIG. 5
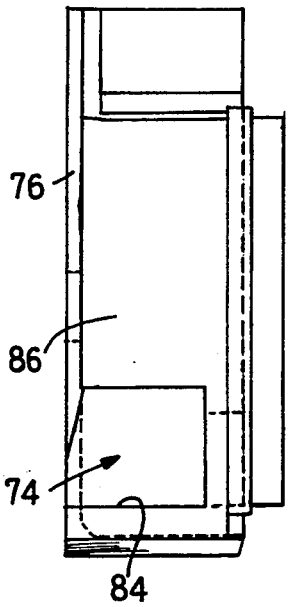
FIG. 6
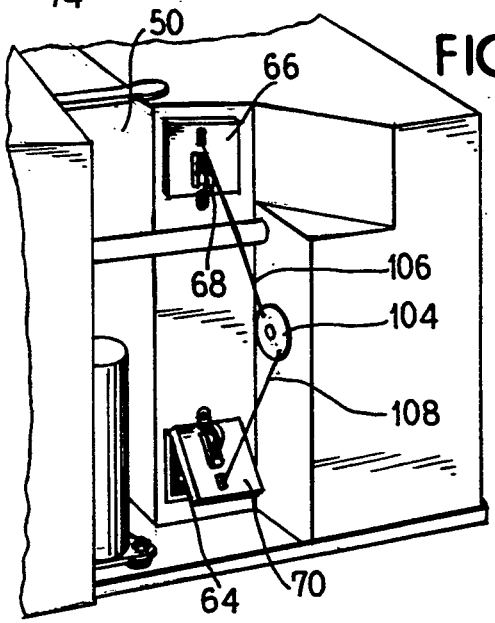
FIG. 7
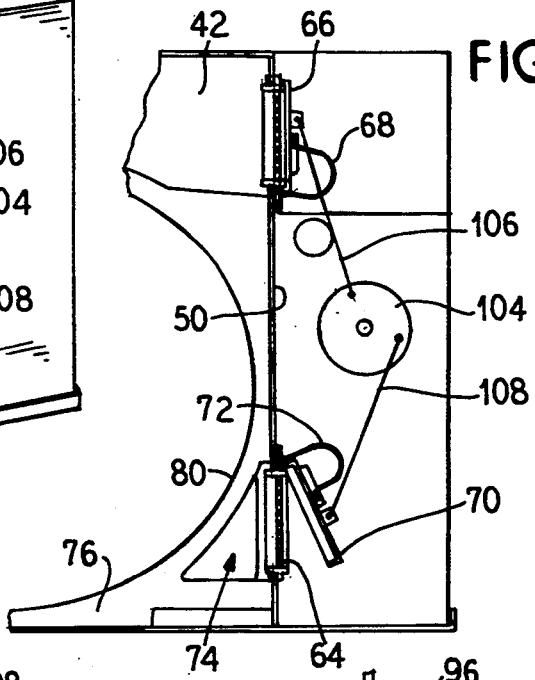
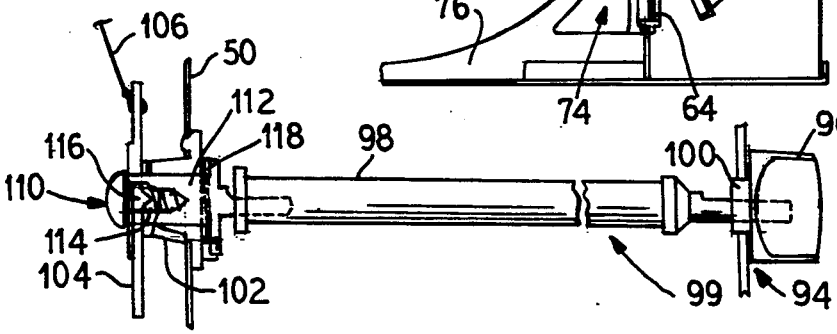
FIG. 8

EXHAUST AND FRESH AIR VENTILATION SYSTEM FOR A ROOM AIR CONDITIONER

BACKGROUND OF THE INVENTION

The present invention relates to construction of a room air conditioner and more particularly to the provision of an exhaust and fresh air ventilation system in such an air conditioner.

In room air conditioners it is oftentimes desirable to draw fresh air from outdoors into the room through the air conditioner by utilizing the fans of the air conditioner and at other times it is desirable to exhaust room air out to the outdoors again using the fans of the air conditioner. However, in past constructions the arrangements for providing either the exhaust function or the fresh air function have resulted in relatively complex controls and air conduit arrangements. It would therefore be an improvement in the art if there were provided a simplified control mechanism and a simplified air conduit path which would minimize the space requirements in the air conditioner to provide these functions.

SUMMARY OF THE INVENTION

The present invention provides a room air conditioner including a ventilation system to exhaust room air and to provide fresh air from the outdoors. This system utilizes a simple manual control mechanism in which a single rotary actuator is utilized to provide either the exhaust air function or fresh air function. Further, very simplified air conduit arrangements are provided which do not require any additional useable space within the air conditioner for providing these functions.

Such an air conditioner has an external housing within which all of the components for the air conditioner are located. The air conditioner includes a compressor, a condenser and an evaporator in the standard arrangement, all of these components being located within the housing. A divider wall separates an interior of the housing into two spaces, a first space containing the condenser and communicating with an area outside of the room, and a second space containing the evaporator and communicating with the room to an inlet opening and a discharge opening.

A means for moving air, which may be a blower wheel, creates a low pressure zone in an area adjacent to the evaporator causing air to flow from the room through the inlet opening and into the evaporator where it is cooled. The air moving means also creates a high pressure zone on an opposite side of the air moving means in an area adjacent to the discharge opening. This causes air to flow back into the room through the discharge opening.

The ventilation system comprises a first openable door means in the divider wall which is in communication with the high pressure zone. Opening of this door permits air to be exhausted from the second space containing the evaporator into the first space containing the condenser and from there out to the outdoors.

A second openable door means is provided in the divider wall in communication with the low pressure zone. When this door is open, air is drawn from the first space which contains the condenser into the second space which contains the evaporator. Thus, fresh air is drawn from the outdoors through the divider wall by means of this second openable door.

A single mechanical actuator provides the control mechanism for operating both the first openable door means and second openable door means. This mechanical actuator includes a knob which is positioned at the front of the air conditioner for easy access by a user. The knob is connected to an axle extending into the air conditioner housing and which ends in a wheel which has a pair of cables attached to it, one cable going to each of the doors. When the knob is rotated in a first direction, one of the cables is pulled by the cam wheel to cause a selected one of the doors to open while the other cable is slackened. When the knob is turned in the opposite direction the opposite cable is pulled by the cam wheel to open the second door. Both doors are spring loaded so as to remain closed unless the knobs are rotated. The knob includes a detent to hold the selected door open once the knob is rotated into the open door position for the respective door. The center point of rotational travel for the knob will result in both doors being spring biased closed.

BRIEF DESCRIPTION OF THE DRAWINGS

FIG. 4 is a front elevational view of the blower scroll housing.

FIG. 5 is a side elevational view of the blower scroll housing of FIG. 4.

FIG. 6 is a rear side perspective view of the opening actuator mechanism and doors.

FIG. 7 is a rear elevational view of the opening mechanism of FIG. 6.

FIG. 8 is a side sectional view of the opening actuator.

DETAILED DESCRIPTION OF THE PREFERRED EMBODIMENTS

Figure 1:
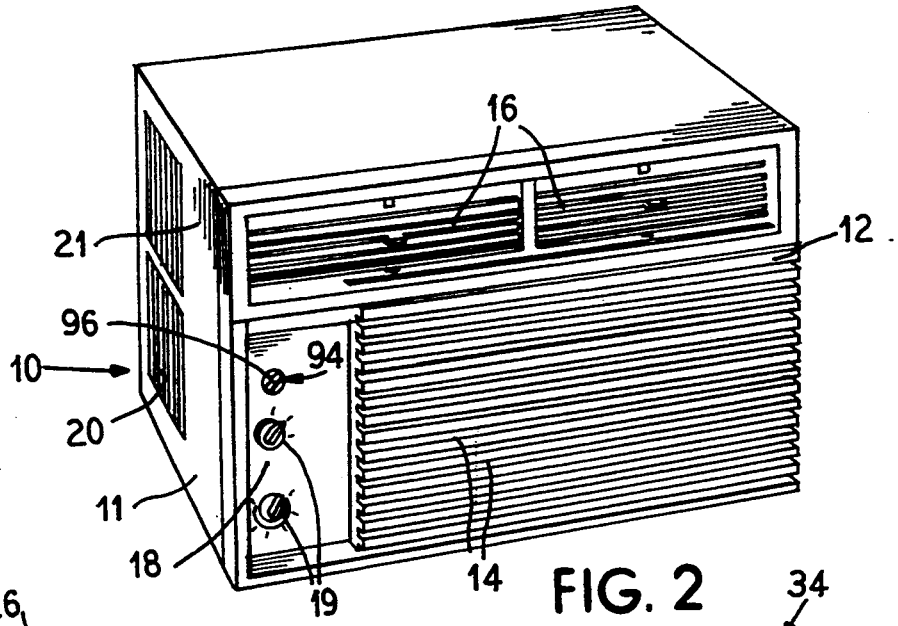
FIG. 1 is a perspective view of a room air conditioner embodying the principles of the present invention.

In FIG. 1 there is illustrated an overall perspective view of a room air conditioner embodying the principles of the present invention, generally at 10. Such a room air conditioner 10 is placed in an opening of a wall of a room to provide cooling of the air within the room. The walls of the room provide an enclosure for isolating the room from the area outside of the room. Oftentimes these air conditioners fit through prefabricated openings in the room walls or through windows.

The air conditioner 10 has a housing or enclosure 11 including a front panel 12 which faces into the room to be cooled. The front panel 12 has a number of openings 14 which comprise air inlet openings to permit air from the room to be drawn into the enclosure 11 of the air conditioner 10. The front panel 12 also has a plurality of openings 16 to permit air to be discharged back into the room from the air conditioner 10. A control panel 18 is provided which contains various control actuators 19 for the air conditioner 10. The air conditioner enclosure 11 also includes a number of openings 20 in sidewalls 21 of the enclosure to permit air from outside of the room to be drawn into the enclosure as is necessary during the operation of the air conditioner 10.

Figure 2:
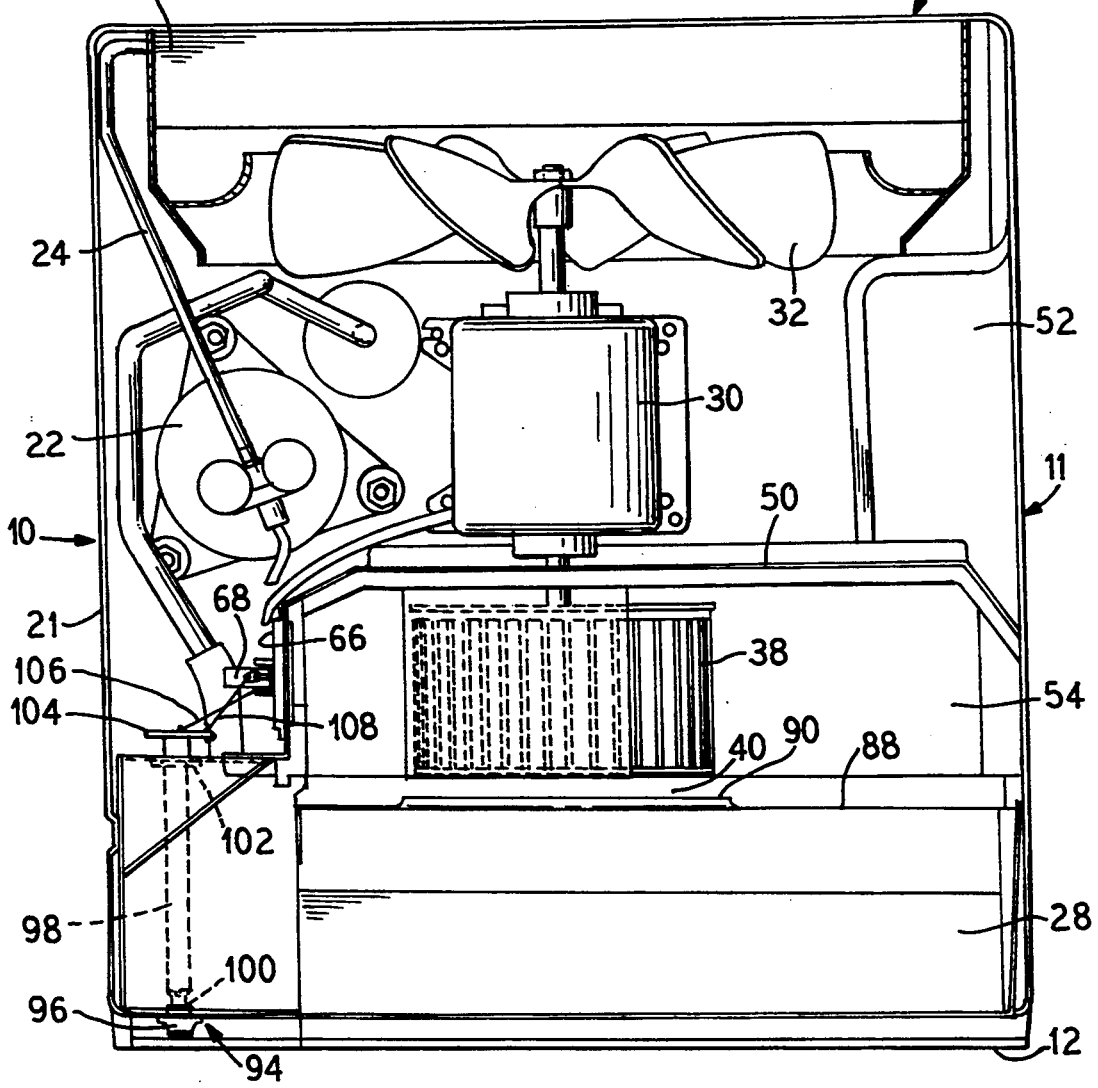
FIG. 2 is a plan view of the air conditioner of FIG. 1 with the enclosure cover removed.

FIG. 2 illustrates the internal components of the air conditioner 10. It is seen that the air conditioner 10 has a compressor 22 for compressing a refrigerant which flows through a conduit 24 and through a condenser 26 where heat from the refrigerant is released. The refrigerant is then caused to flow through an evaporator 28 where heat is absorbed into the refrigerant. The refrigerant then returns to the compressor 22 for repeating the cycle. A single motor 30 is provided to drive a first air moving device in the form of a fan 32 to cause air to flow through the condenser 26 to exhaust heat from the condenser through rear air outlets 34 to the area outside of the room. The air driven by this fan 32 is drawn into the enclosure 11 through the openings 20 in the side walls 21 of the enclosure 11.

Figure 3:
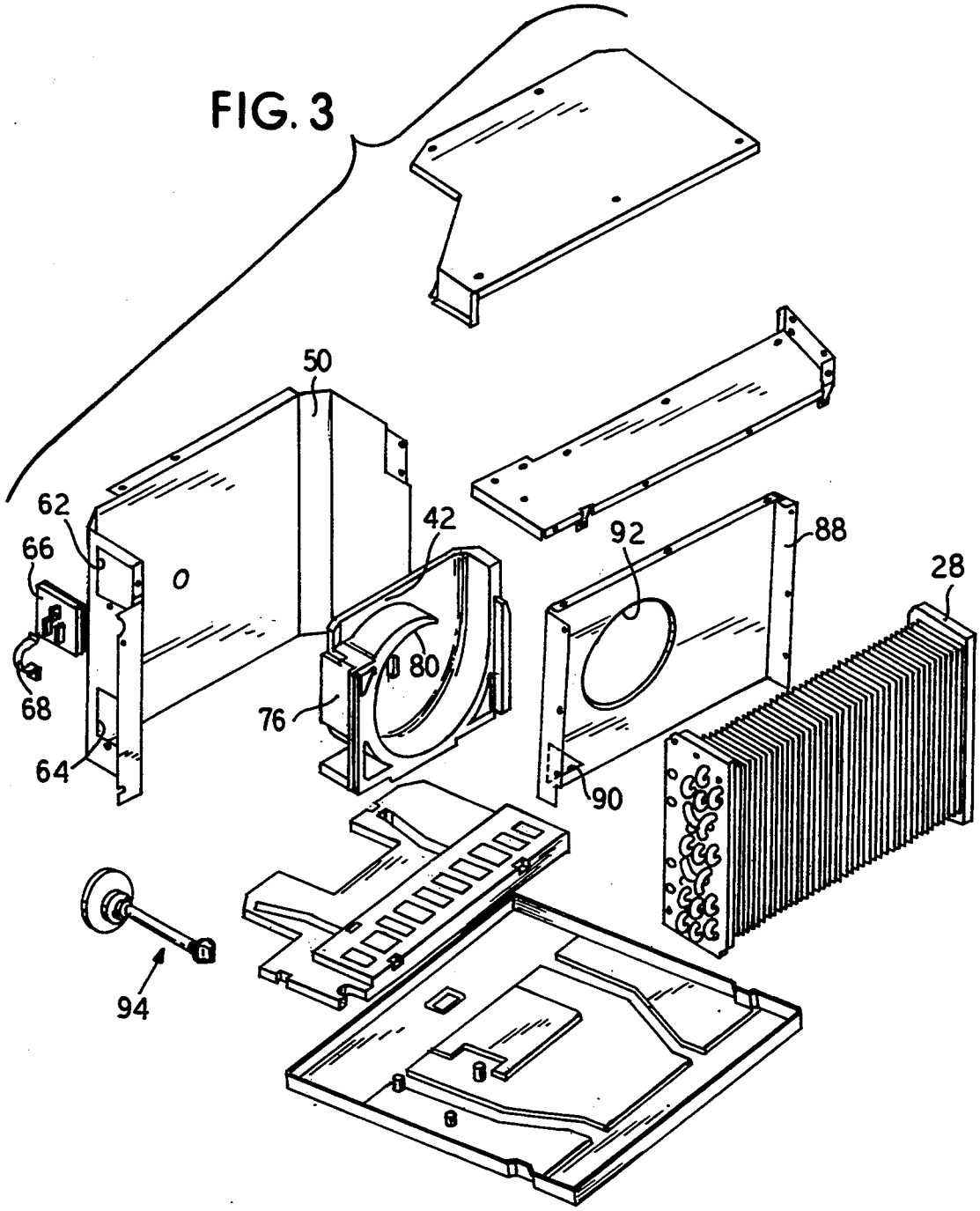
FIG. 3 is an exploded view of various components within the cool side of the air conditioner.

The motor 30 also drives a second air moving means 38 which may be in the form of a blower wheel. The blower wheel 38 creates a low pressure zone in an area 40 adjacent to the evaporator 28, but on the blower wheel side of the evaporator. This causes air from the room to flow through the openings 14 in the front grill 12 and through the evaporator 28, thereby releasing heat from the air to the refrigerant flowing through the evaporator, and then into the blower wheel 38. The air is then discharged from the blower wheel 38 into a zone 42 (FIGS. 3, 4 and 7) at a higher pressure from where the air flows out through the openings 16 in the front panel 12 to return to the room.

In order to prevent the air which is being cooled by flowing through the evaporator 28 from mixing with the outdoor air, a divider wall 50 is provided which separates the interior of the air conditioner enclosure 11 into two spaces. A first space 52 is the area which includes the condenser 26, the compressor 22 and motor 30 and is referred to as the hot side of the air conditioner 10. A second space 54 includes the evaporator 28 and the blower wheel 38 and is referred to as the cool side of the air conditioner 10. Thus, during normal cooling operation by the air conditioner 10, the air from within the room is circulated through the evaporator 28 and blower wheel 38 and returned to the room, the whole time remaining in the second space 54 within the air conditioner 10. In the meantime, outdoor air is drawn into the first space 52 of the housing to flow over the compressor 22, the motor 30, through the fan 32 and condenser 26 to return outdoors carrying the waste heat with it. The two air flows thus remain isolated from one another by the divider wall 50.

However, it is desirable to provide the ability to exhaust room air from the room through the air conditioner 10 by utilizing the air moving devices 38, 32 within the air conditioner during certain occasions and, during other occasions, to draw fresh outdoor air into the room, again using the fans of the air conditioner. In order to accomplish these alternate uses of the air conditioner 10, a pair of openings 62, 64 are provided in the divider wall. The first opening 62 is normally closed by a first door 66 which is pivotally secured to the divider wall 50. The door is engaged by a spring 68 to be normally biased into a closed position relative to the opening 62. The opening 62 is positioned in communication with the high pressure zone 42, created by the blower wheel 38, such that when the door 66 is opened, air from within the high pressure zone will be caused to flow out through the opening 62 past the door 66 into the first area 52 of the air conditioner housing 11.

The second opening 64 is normally closed by a door 70 (FIGS. 6 and 7) which is secured to the divider wall 50 and is pivotally openable. The second door 70 also is engaged by a spring 72 to normally hold the door 70 in a closed position relative to the second opening 64. The second opening 64 is positioned to communicate with the low pressure zone 40 created by the blower wheel 38. To provide this communication an air conduit 74 is formed in a blower wheel scroll 76 as best seen in FIGS. 4, 5 and 7. The scroll 76 has a generally spiral wall 80 which surrounds a portion of the blower wheel 38. The wall 80 gets progressively further away from the blower wheel 38 in a direction of rotation of the blower wheel leading toward the high pressure zone 42. A lower left portion 81 of the scroll 76, as seen in FIG. 4, has a passage 82 formed therein which, in turn, has an opening 84 formed through a sidewall 86 thereof communicating with the opening 64 in the divider wall. Therefore, the air conduit 74 is formed by the passage 82 in the scroll 76, in an unused portion of the scroll, thus not requiring use of any useable space within the air conditioner housing 11.

A forward end of the passage 82 is engaged by an evaporator shroud 88 (FIG. 3) and an opening 90 is formed in the evaporator shroud which is in alignment with the passage 82 of the scroll 76. This allows air to flow through opening 64, opening 84, into air passage 82 and then through the opening 90 in the evaporator shroud 88 to exit into a rear area of the evaporator 28 itself. The air then flows upwardly along the evaporator shroud 88 and through a large opening 92 in the evaporator shroud leading into the low pressure zone 40 created by the blower wheel 38. Thus, outdoor air is drawn in through the opened door 70 by the blower wheel 38 to be moved to the high pressure zone 42 and discharged into the room through the discharge openings 16 in the front panel 12 of the air conditioner housing 11.

A single actuator 94 (FIGS. 6 and 8) is provided for opening both of the doors 66, 70. The actuator consists of a knob 96 accessible from the front of the air conditioner at the control panel 18. The knob 96 is connected to rotate an axle 98 which extends through the control area 99 for the air conditioner and which is carried in a pair of bearings 100, 102 and extends into the first space 52 on the backside of the divider wall 50. At an end of the axle 98 there is carried a wheel 104 which also rotates with the axle 98 and knob 96. A pair of cables 106, 108 extend from the wheel 104 at a periphery thereof. Rotation of the knob 96 will cause rotation of the wheel 104 and will cause one or the other of the cables 106, 108 be pulled by the wheel 104, thus pulling an opposite end of one of the cables 106, 108 toward the cam wheel 104. The cable not pulled will be slackened by rotation of the wheel. The opposite ends of the cables are attached to the doors 66, 70 respectively. Thus, rotation of the knob 96 in a first direction of rotation will cause the first door 66 to be pivoted open against the bias of spring 68. Rotation of the knob 96 in the opposite direction will cause the opening of door 70 against the bias of spring 72 as shown in FIGS. 6 and 7.

A detent mechanism 110 is provided on the actuator 94 such that when the knob 96 is rotated to a fresh air position, the door 70 remains opened against the bias of spring 72 until the detent holding force is overcome by manual rotation of the knob 96 back to the central position allowing the door 70 to be closed under the bias of spring 72. Similarly, when the knob 96 is rotated to the exhaust air position, the door 66 is held open against the spring bias 68 until manual force on the knob 96 overcomes the holding force of the detent 110 to permit the door 66 to be closed by the spring 68.

In a preferred arrangement the detent mechanism comprises a stationary cylindrical bearing member 102 captured on said divider wall 50 through which the axle 98 or an extension 112 thereof extends. An end face of the cylindrical member has three indents 114 spaced apart by 60°. The wheel 104 has three protrusions 116 also spaced apart by 60° which are complementarily shaped to the indents 114. A wave washer 118 holds the wheel 104 against the cylindrical member 112 so that the wheel can be moved to any one of the three positions of: the first door open, the second door open or both doors closed.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. In an air conditioner for cooling a room isolated from an area outside of said room, said air conditioner having an evaporator and an air moving means for creating a low pressure zone and a high pressure zone through movement of air from said low pressure zone to said high pressure zone, said low pressure zone communicating with said evaporator and said room for drawing air from said room through said evaporator toward said air moving means, an air discharge means in communication with said high pressure zone for directing air back into said room, said high and low pressure zones being defined by wall means for isolating said zones from said area outside of said room, and means for providing communication between said area and said low and high pressure zones comprising:

first openable door means in said wall means selectively providing a communication path between said area and said high pressure zone;

second openable door means in said wall means selectively providing a communication path between said area and said low pressure zone; and control means manually operated at a front of said air conditioner to selectively open and close both of said first and second door means comprising a single mechanical actuator, said control means comprising a rotary knob mechanically connected to both of said door means, wherein said rotary knob comprises a wheel with cable means secured thereto, said cable means attached to both of said door means, wherein, upon rotation of said knob in one direction, said cable means will pull against one of said door means to open it and upon rotation of said knob in an opposite direction, said cable means will pull against the other of said door means to open it.

2. An air conditioner according to claim 1, wherein said air moving means comprises a blower wheel.

3. An air conditioner according to claim 2, including a shroud surrounding said blower wheel with an air passage formed in said shroud leading from said second door means to said low pressure zone.

4. An air conditioner according to claim 1, wherein a detent is provided on said rotary knob to provide a holding force to keep said knob in a rotated position to hold a selected one of said doors in an open position until said holding force is manually overcome and said knob is rotated away from said rotated position.

5. An air conditioner according to claim 1, wherein said first and second openable door means are pivotally openable and spring biased into a closed position.

6. An air conditioner according to claim 1, wherein said wall means comprises a divider wall dividing an interior of said air conditioner into two spaces.

7. An air conditioner for use in cooling a room isolated from an area outside of said room comprising:

an external housing;

a compressor, a condenser and an evaporator mounted within said housing;

a divider wall separating an interior of said housing into two spaces, a first space containing said condenser and communicating with said area outside of said room and a second space containing said evaporator and communicating with said room through an inlet opening and a discharge opening;

air moving means in said second space for creating a low pressure zone in an area adjacent said evaporator causing air to flow from said room through said inlet opening into said evaporator and a high pressure zone in an area adjacent said discharge opening causing air to flow into said room through said discharge opening;

first openable door means in said divider wall in communication with said high pressure zone to permit air to be exhausted from said second space into said first space;

second openable door means in said divider wall in communication with said low pressure zone to permit air to be drawn from said first space into said second space; and control means operated at a front of said air conditioner to selectively open and close both of said first and second door means comprising a single mechanical actuator, said control means comprising a rotary knob mechanically connected to both of said door means, wherein said rotary knob comprises a wheel with cable means secured thereto, said cable means attached to both of said door means, wherein, upon rotation of said knob in one direction, said cable means will pull against one of said door means to open it and upon rotation of said knob in an opposite direction, said cable means will pull against the other of said door means to open it.

8. An air conditioner according to claim 7, wherein said air moving means comprises a blower wheel.

9. An air conditioner according to claim 8, including a shroud surrounding said blower wheel with an air passage formed in said shroud leading from said second door means to said low pressure zone.

10. An air conditioner according to claim 7, wherein a detent is provided on said rotary knob to provide a holding force to keep said knob in a rotated position to hold a selected one of said doors in an open position until said holding force is manually overcome and said knob is rotated away from said rotated position.

11. An air conditioner according to claim 7, wherein said first and second openable door means are pivotally openable and spring biased into a closed position.

12. An air conditioner for use in cooling a room isolated from an area outside of said room comprising:

an external housing;

a compressor, a condenser and an evaporator mounted within said housing;

a divider wall separating an interior of said housing into two spaces, a first space containing said condenser and communicating with said area outside of said room and a second space containing said evaporator and communicating with said room through an inlet opening and a discharge opening;

air moving means in said second space for creating a low pressure zone in an area adjacent said evaporator causing air to flow from said room through said inlet opening into said evaporator and a high pressure zone in an area adjacent said discharge opening causing air to flow into said room through said discharge opening;

first openable door means in said divider wall in communication with said high pressure zone to permit air to be exhausted from said second space into said first space;

second openable door means in said divider wall in communication with said low pressure zone to permit air to be drawn from said first space into said second space;

a shroud surrounding said blower wheel with an air passage formed in said shroud leading from said second door means to said lower pressure zone;

control means operated at a front of said air conditioner to selectively open and close both of said first and second door means comprising a single rotary knob mechanically connected to both of said door means;

wherein said rotary knob comprises a wheel with cable means secured thereto, said cable means attached to both of said door means, wherein, upon rotation of said knob in one direction, said cable means will pull against one of said door means to open it and upon rotation of said knob in an opposite direction, said cable means will pull against the other of said door means to open it.

13. An air conditioner according to claim 12, wherein a detent is provided on said rotary knob to provide a holding force to keep said knob in a rotated position to hold a selected one of said doors in an open position until said holding force is manually overcome and said knob is rotated away from said rotated position.

14. An air conditioner according to claim 12, wherein said first and second openable door means are pivotally openable and spring biased into a closed position.

15. An air conditioner according to claim 12, including a shroud surrounding said blower wheel with an air passage formed in said shroud leading from said second door means to said low pressure zone.

* * * * *